United States Patent [19]

Lewis et al.

[11] 4,170,111

[45] Oct. 9, 1979

[54] THRUST AUGMENTOR

[75] Inventors: George D. Lewis, North Palm Beach; James H. Shadowen, Riviera Beach, both of Fla.

[73] Assignee: United Technologies Corporation, Hartford, Conn.

[21] Appl. No.: 849,906

[22] Filed: Nov. 9, 1977

[51] Int. Cl.[2] ..... F02K 3/10; F02K 3/06; F02K 1/02

[52] U.S. Cl. ..... 60/261; 60/262; 60/39.72 R; 60/39.82 P

[58] Field of Search ..... 60/39.72 R, 39.71, 39.82 P, 60/261, 262, 224; 237/127.3, 265.17

[56] References Cited

U.S. PATENT DOCUMENTS

| | | | |
|---|---|---|---|
| 2,622,396 | 12/1952 | Clarke et al. | 60/39.71 |
| 2,673,445 | 3/1954 | Bruckmann | 60/261 |
| 2,697,910 | 12/1954 | Brzozowski | 60/39.82 P |
| 2,938,332 | 5/1960 | Boyd et al. | 60/224 |
| 3,368,352 | 2/1968 | Hewson | 60/262 |
| 3,373,562 | 3/1968 | Wormser | 60/39.72 R |
| 3,528,250 | 9/1970 | Johnson | 60/261 |
| 3,540,216 | 11/1970 | Quilleuere et al. | 60/261 |
| 3,677,012 | 7/1972 | Batscha | 60/262 |
| 3,747,345 | 7/1973 | Markowski | 60/39.72 R |

FOREIGN PATENT DOCUMENTS

| | | | |
|---|---|---|---|
| 1081277 | 5/1960 | Fed. Rep. of Germany | 60/262 |

*Primary Examiner*—Carlton R. Croyle
*Assistant Examiner*—Thomas I. Ross
*Attorney, Agent, or Firm*—Robert C. Walker

[57] ABSTRACT

A thrust augmentor for a turbofan, gas turbine engine is disclosed. Techniques for mixing and burning dissimilar density gases in a thrust augmentor are developed. In accordance with one specific teaching the flame front in a swirl augmentor is stabilized by a continuously operative pilot burner. The pilot burner is positioned in the radially outward portion of the augmentor. The pilot burner employs fuel premixing techniques and is adapted to operate at low inlet pressure levels.

10 Claims, 3 Drawing Figures

THRUST AUGMENTOR

BACKGROUND OF THE INVENTION

1. Field of the Invention

This invention relates to thrust augmentation in gas turbine engines, and more particularly to pilot stabilized combustion in a swirl augmentor.

2. Description of the Prior Art

Turbojet engines for aircraft use operatively produce a stream of gases exiting from the engine. The thrust generated by an engine is a function of the exhaust gas velocity and of the exhaust gas pressure. The higher the velocity and the higher the pressure of the exiting gases, the higher the corresponding thrust becomes. To obtain high velocities, fuel and high pressure air are burned in a combustion chamber within the engine. The high pressure air is supplied to the combustion chamber by a compressor upstream of the chamber. A predominant amount of the energy added to the medium gases in the combustion process is used to drive the compressor. The remaining portion of the added energy is convertible to engine thrust.

Early in the development of turboject engines and in response to the military need for high performance aircraft, a second combustion station was added downstream of the turbine section to augment the thrust contribution of the main combustor. At the second combustion station the velocity of the gases is increased by adding additional energy to the gases. Combustion at the second station has become commonly known as "augmenting" or "after-burning", reburning of the gases originally burned in the main combustor.

Techniques employed in afterburners were at their inception, and remain today, quite distinct from those employed in main combustors. In particular, combustion concepts directed to the stabilization of a flame front at each respective combustion station differ widely. In main combustors the aerodynamic effects of locally swirling gases are employed to stabilize the flame front at the desired location. U.S. Pat. No. 2,676,460 to Brown entitled "Burner Construction of the Can-Annular Type Having Means For Distributing Airflow to Each Can" is representative of swirl stabilized main combustors. In augmentors, on the other hand, bluff body flameholders are disposed across the path of the medium gases to induce recirculation of gases behind the flameholders. Recirculation of the gases stabilizes and holds the flame front at the proximate location of the flameholder. U.S. Pat. No. 2,702,452 to Taylor entitled "Flameholder Construction" is representative of early concepts for flameholder stabilization in augmentors.

The augmentor of Taylor is directed to a turbojet type gas turbine engine. Since the early 1960's, however, gas turbine engines of prime importance have been those based upon the turbofan cycle. In a turbofan cycle engine a substantial portion of the air flowing through the engine is caused to bypass the main combustor. At the augmentor, therefore, the gas stream is comprised of a central core stream of relatively hot gases from the main combustor and a surrounding bypass stream of relatively cool gases. Before effective combustion of the combined streams can be affected, the cold air stream must be heated as through mixing with the hot core gases. One widely accepted technique for mixing the gases is to shape the afterburner flameholder such that it causes hot gases of the core to be directed outwardly into the cold air stream. U.S. Pat. No. 3,295,325 to Nelson entitled "Jet Engine Afterburner Flameholder" illustrates such a shaped flameholder and describes its operation.

Very recent advances in combustor and augmentor technology are disclosed in U.S. Pat. No. 3,788,065 to Markowski entitled "Annular Combustion Chamber For Dissimilar Fluids in Swirling Flow Relationship" and in U.S. Pat. No. 3,747,345 to Markowski entitled "Shortened Afterburner Construction For Turbine Engine" which adapts the concepts of the U.S. Pat. No. 3,788,065 to augmentor embodiments. The concepts disclosed in these Markowski patents are now known in the industry as "swirl burning". Note in the U.S. Pat. No. 3,747,345 that, even with these most recent combustion techniques, the flame stabilization concepts of prior turbojet and turbofan augmentors are utilized.

Scientists and engineers in the gas turbine field are continuing to search for new stabilization concepts and techniques, and particularly those which can adapt swirl burning techniques to effective embodiments.

SUMMARY OF THE INVENTION

A primary object of the present invention is to provide a thrust augmentor capable of reliable and stable operation over a wide range of engine operating conditions. The employment of swirl burning principles in the augmentor is one particular aim, and effective means for stabilizing the flame front in such an augmentor is sought.

According to the present invention, a continuously operative pilot burner positioned in the radially outward region of a thrust augmentor ignites and stabilizes the combustion of differing density gases in a strongly swirling flow field.

A primary feature of the present invention is the swirl augmentor. An inner row of vanes in the core duct and an outer row of vanes in the bypass duct are adapted to establish two concentric swirling flows. In at least one embodiment the inner and outer vanes are rotatable so as to vary the amount of swirl imparted to the gases flowing thereacross. Another feature is the pilot burner positioned radially outward of the concentric flows. Means for supplying fuel to the augmentor is positioned inwardly of the flow divider. The pilot burner is of the annular premixing type and includes a plurality of circumferentially spaced vanes disposed across the fuel/air mixture. The burner has a convergent passage immediately upstream of the vanes and a divergent passage immediately downstream of the vanes. An essentially cylindrical flow guide extends downstream of the inner ends of the vanes into the divergent passage.

A principal advantage of augmentor apparatus incorporating the concepts of the present invention is reduced susceptibility to lean blowouts. In the apparatus disclosed, the blowout limit of the augmentor is defined by the lean flammability limit of the pilot burner alone. Another advantage is reduced drag losses in the augmentor as enabled through the elimination of a mechanical flameholder in the main flow of the augmentor. The pilot burner positions and stabilizes the flame front within the augmentor and is operable over a wide range of inlet pressures.

The foregoing and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
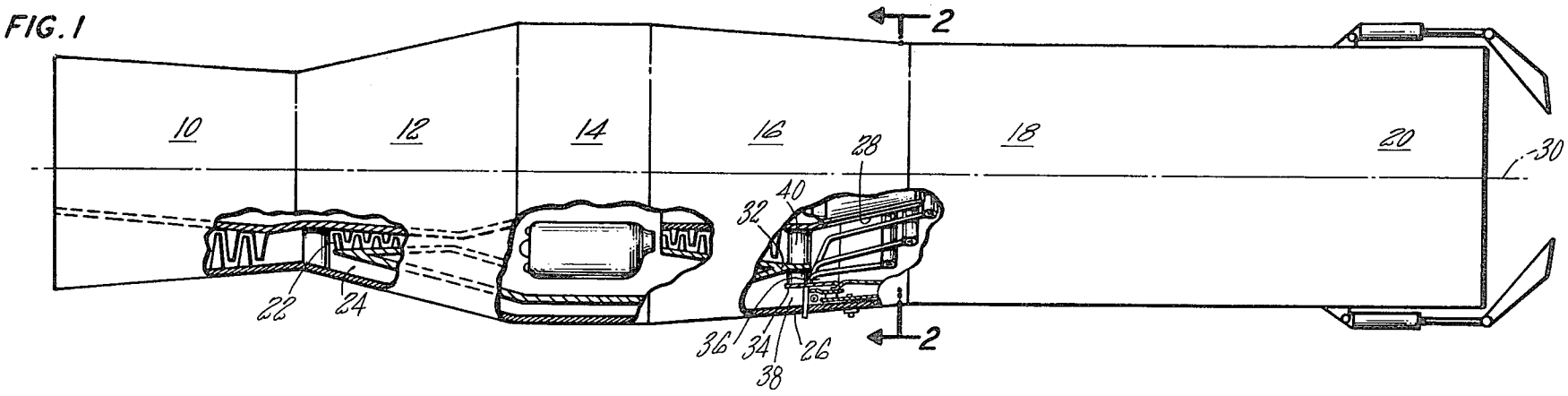
FIG. 1 is a simplified, partial cross section illustration of a turbofan, gas turbine engine showing detailed components of the thrust augmentor.

An augmented turbofan engine is illustrated in FIG. 1. The engine principally includes a fan section 10, a compressor section 12, a main combustor section 14, a turbine section 16, a thrust augmentor section 18 and an exhaust nozzle section 20. A core duct 22 carries to the compressor section a portion of the working medium gases discharged from the fan section. These gases are subsequently flowed through the main combustor section and through the turbine section to the augmentor section of the engine. The gases flowing through the core duct are hereinafter referred to as "core gases". A bypass duct 24 carries the remaining portion of the working medium gases discharged from the fam section, around the compressor, main combustor, and turbine sections to the augmentor section. The gases flowing through the bypass duct are hereinafter referred to as "bypass gases".

The thrust augmentor section is enclosed within a casing 26. A tailcone 28 is centered about the engine axis 30. An intermediate casing 32 separates the core gases entering the augmentor and the bypass gases entering the augmentor into two concentric streams. A flow divider 34 is spaced radially between the intermediate casing and the augmentor casing to divide the bypass gases into an inner stream 36 and an outer stream 38.

A plurality of core vanes 40 is disposed across the core gases between the tailcone and the intermediate casing. A plurality of bypass vanes 42 is disposed across the inner stream of the bypass gases between the intermediate casing and the flow divider. Both the core vanes and the bypass vanes are adapted to swirl the flow passing thereacross circumferentially about the engine and in the same direction. A plurality of circumferentially extending spray rings 44 is disposed across the augmentor downstream of the core vanes and the bypass vanes. Fuel supply means 46 direct the main augmentor fuel to the spray rings.

Figure 3:
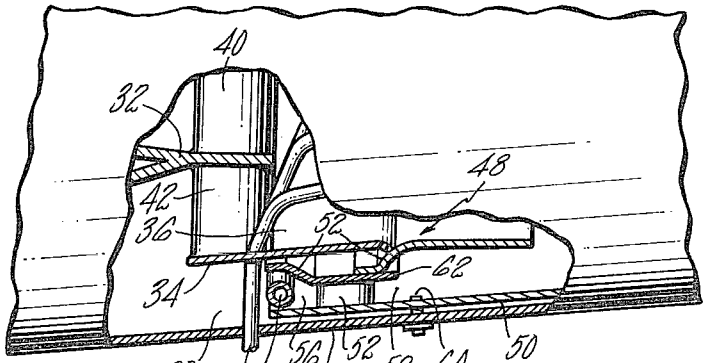
FIG. 3 is an enlarged view of the augmentor pilot.

A pilot burner 48 is positioned radially outward of the flow divider. The pilot burner, as shown in greater detail in FIG. 3, has an essentially cylindrical outer liner 50 which is concentric with the augmentor casing 26. A plurality of circumferentially spaced pilot vanes 52 extend radially inward from the outer liner to an inner liner 54. A convergent passage 56 is formed between the inner and outer liners upstream of the vanes and a divergent passage 58 is formed immediately downstream of the vanes. Fuel injection means, such as the spray ring 60 is disposed to discharge fuel into the convergent passage 56 where the fuel becomes mixed with air flowing into the pilot burner. A cylindrical flow guide 62 extends into the divergent passage 58 from the radially inner ends of the pilot vanes. The flow guide extends over a comparatively short axial length and, in the contour illustrated one hundred thousandths to two hundred thousandths of an inch (0.100–0.200 inch) is known to be adequate. The outer liner 50 is penetrated by an igniter 64.

During operation of the augmentor fuel and air are mixed in the convergent passage 56 of the pilot burner. The fuel/air mixture accelerates as the passage decreases in the cross-sectional area. As the mixture is directed across the pilot vanes 52, the vanes impart a circumferential swirl to the mixture. Swirling the mixture establishes a radial static pressure gradient across the flow. A swirl angle of discharge across the vanes of fifty degrees (50°) is known to be effective in establishing the gradient. The flow containing the radial pressure gradient is directed into the divergent passage 58, past the flow guide 62. Sudden expansion of the flow into the divergent passage at the end of the flow guide causes recirculation of the fuel/air mixture and a substantial residence time of the mixture in the region. As a result of the substantial residence time, combustion in the pilot burner is quite stable once the mixture is ignited by the igniter 64.

Hot gases of low density are discharged from the pilot burner. The temperature of the gases is on the order of thirty-six hundred degrees Rankine (3600° R.) and the density is approximately twenty-seven thousandths of a pound per cubic foot (0.27 lb/ft$^3$).

Figure 2:
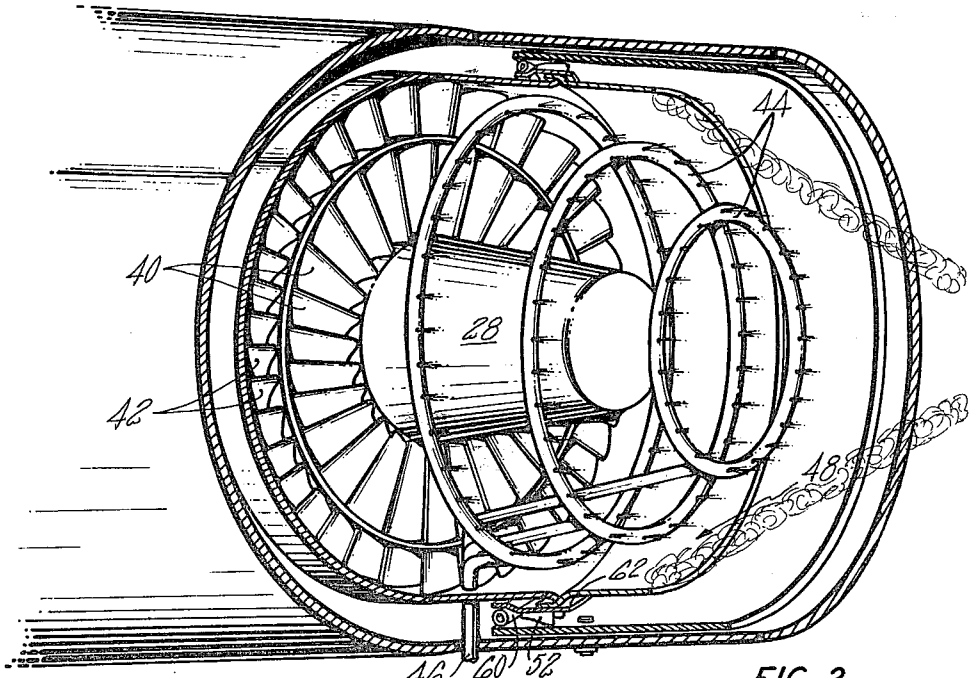
FIG. 2 is a simplified, partial perspective view of the augmentor illustrated in FIG. 1.

As is illustrated in FIG. 2, the core vanes 40 and the bypass vanes 42 are adapted to swirl the respective streams flowing thereacross in a circumferential direction about the axis of the engine. A swirl angle of discharge from the vanes on the order of twenty to thirty-five degrees (20°–35°) during augmentor operation is desired such that a strongly swirling flow field is established. The density of the core gases in the swirling field at sea level takeoff condition is approximately sixty-seven thousandths of a pound per cubic foot (0.067 lb/ft$^3$) and the density of the bypass gases at sea level takeoff condition in the swirling field is approximately one hundred sixty-seven thousandths of a pound per cubic foot (0.167 lb/ft$^3$).

One of the major attributes of the augmentor of the present invention is the ability of the apparatus to cause mixing of the bypass and core streams. Directing the core and bypass streams across the core vanes and bypass vanes respectively induces a strongly swirling flow field. The bypass gases are centrifuged radially outward in the swirling flow field thereby displacing the hot pilot gases discharged by the pilot burner. The bypass gases become ignited by the pilot and a flame front is established. The flame front progresses radially inward toward the axis of the engine in a conical pattern as illustrated in FIG. 2. As soon as the flame front penetrates the path of the bypass gases, the core gases become the relatively more dense medium and the core gases in turn become centrifuged outwardly into the combined pilot and bypass gas streams. Complete mixing and burning of both the core and bypass streams without the need of mechanical flameholders or mixers results.

The pilot burner is operative over the entire range of augmentor conditions and serves to position, hold and stabilize the augmentor flame front downstream of the spray rings 44. The pilot burning concepts are particularly advantageous in preventing lean blowout of the augmentor such as occurs in more conventional augmentors under low fuel flow conditions. In effect, the lean blowout point becomes the lean flammability limit of the pilot. As long as the pilot is operating the main-stream augmentor flow can be ignited and stabilized.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new aand desire to secure by Letters Patent of the United States is:

1. An augmentor structure of the type adapted for use with a gas turbine engine having a core stream and a bypass stream of relatively high density working medium gases wherein said augmentor includes:

an annular pilot burner circumscribing said bypass stream and adapted to produce during operation an annular stream of relatively low density working medium gases;

means for injecting fuel into said core and bypass stream; and means for inducing swirl in said core and bypass streams such that the medium gases of the core and bypass streams are impelled radially outward into said medium gases emanating from the pilot burner;

wherein said annular pilot burner is of the premixing type.

2. The invention according to claim 1 wherein said pilot burner is formed of an essentially cylindrical outer liner, an inner liner which is spaced radially inward of said outer liner, and a plurality of circumferentially spaced pilot vanes which extend radially between said inner liner and said outer liner wherein the inner liner diverges inwardly from said outer liner in the upstream direction from the pilot vanes to form an annular, convergent passage at the upstream end of the pilot burner and wherein the inner liner diverges inwardly from the outer liner in the downstream direction from the pilot vanes to form an annular divergent passage at the downstream end of the pilot burner.

3. The invention according to claim 2 wherein said pilot vanes are adapted to direct flow thereacross at a swirl angle of approximately fifty degrees (50°).

4. For a turbofan engine of the type adapted to produce a core stream and a bypass stream of working medium gases, a thrust augmentor comprising:

an augmentor casing;

a tailcone positioned internally of said augmentor casing;

an intermediate casing disposed radially between said tailcone and said augmentor casing, and separating the core stream of working medium gases from the bypass stream of working medium gases;

a circumferentially extending flow divider spaced radially between said intermediate casing and said augmentor casing, and which is adapted to separate the bypass stream into a radially inner stream and a radially outer stream;

a plurality of circumferentially spaced core vanes extending between said intermediate casing and said tailcone;

a plurality of circumferentially spaced bypass vanes extending radially between said flow divider and said intermediate casing;

main fuel supply means spaced axially downstream of said core and bypass vanes;

an annular pilot burner disposed across the path of said outer stream between said flow divider and said casing wherein said pilot burner is adapted to produce an annular stream of high temperature, relatively low density effluent and includes a plurality of circumferentially spaced vanes at the upstream end thereof, fuel supply means for the pilot burner spaced upstream of said pilot vanes, and ignition means for said pilot burner which are spaced axially downstream of said pilot vanes wherein said bypass and core vanes are adapted to centrifuge the gases flowing thereacross radially outward into the effluent from said pilot burner.

5. The invention according to claim 4 wherein said pilot burner comprises:

an essentially cylindrical outer liner; and an inner liner which is spaced radially inward of said outer liner wherein said pilot vanes extend radially between said inner liner and said outer liner and wherein the inner liner diverges inwardly from the outer liner in the upstream direction from the pilot vanes to form an annular, convergent passage at the upstream end of the pilot burner, and wherein the inner liner diverges inwardly from the outer liner in the downstream direction from the pilot vanes to form an annular divergent passage downstream of the vanes.

6. The invention according to claim 5 wherein:

said fuel supply means for the pilot burner is positioned so as to discharge fuel into said convergent passage, and said ignition means is positioned within said divergent passage.

7. The invention according to claim 6 wherein each of said pilot vanes has a radially inner end and which further includes a cylindrical flow guide extending in the downstream direction into said divergent passage from the inner ends of said pilot vanes.

8. The invention according to claim 7 wherein said flow guide extends into said divergent section approximately one hundred to two hundred thousandths (0.100 to 0.200) of an inch.

9. The invention according to claim 4 wherein said core vanes and said bypass vanes are adapted to direct flow thereacross at a swirl angle of twenty to thirty-five degrees (20°–35°) during augmentor operation.

10. The invention according to claim 4 wherein said pilot vanes are adapted to direct flow thereacross at a swirl angle of approximately fifty degrees (50°).

* * * * *